United States Patent [19]

Smith

[11] 3,972,565

[45] Aug. 3, 1976

[54] COUCH

[76] Inventor: Edwin Smith, 102 Joe Lee, Lot L, San Antonio, Tex. 78233

[22] Filed: July 23, 1975

[21] Appl. No.: 598,286

[52] U.S. Cl. ..... 297/455; 5/357; 297/445; 297/DIG. 1

[51] Int. Cl.[2] ..... A47C 7/02

[58] Field of Search ..... 297/452, 445, 440, 456, 297/455, 92, 283, DIG. 1, 454, 463; 428/71, 192, 313; 5/345 R, 361 B, 338, 352, 357

[56] References Cited

UNITED STATES PATENTS

| | | | |
|---|---|---|---|
| 656,391 | 8/1900 | Conrad | 297/283 |
| 1,052,698 | 2/1913 | Treiber | 5/357 X |
| 1,597,940 | 8/1926 | Whedon | 297/283 |
| 2,259,534 | 10/1941 | Reynolds | 297/DIG. 1 |
| 2,779,031 | 1/1957 | Arpin | 5/352 X |
| 2,960,152 | 11/1960 | Wendel | 297/DIG. 1 |
| 3,298,741 | 1/1967 | Lepard, Jr. et al. | 297/DIG. 1 |
| 3,455,604 | 7/1969 | Turcksin | 297/445 X |
| 3,654,061 | 4/1972 | Berwanger | 428/192 X |
| 3,669,495 | 6/1972 | Rudgisch | 297/454 X |

*Primary Examiner*—James T. McCall
*Attorney, Agent, or Firm*—Cox, Smith, Smith, Hale & Guenther Incorporated

[57] ABSTRACT

This invention is a new type of couch or chair using multiple elongated reversible cushions for both the back and seat. The cushion, which may be used any place in the seat or back, has an extension on each end thereof so the back and seat cushions will interlock. The extension also overhangs the front of the couch which forms a part of the couch frame. The couch frame has four legs with the front legs supporting the arm rests and the rear legs supporting the back. A horizontal frame extending between the legs supports the seat cushions. Slats extend horizontally under the cushions for both the seat and back. The frame is formed from wood with saddlebag cushions being draped over the arms of the couch.

8 Claims, 7 Drawing Figures

COUCH

BACKGROUND OF THE INVENTION

This invention relates to a new type of couch and, more particularly, to a couch or chair constructed from reversible interlocking cushions to be used in conjunction with a very simple frame construction.

BRIEF DESCRIPTION OF THE PRIOR ART

Many different types of couches, chairs and sofas have been built in the past, each conforming to the individual views of the designer. The earlier couches had simple frame structures with padded cushions being placed thereon. Many times the cushions used the bottom and the back would have a tendency to scoot from the seat of the couch. Normally the lower cushions would be a different size from the back cushions. The cushions would have a flat rectangular shape wherein a pair of cushions, one for the seat and one for the back, would accommodate one person sitting on the couch. Some of the earlier designed cushions to be used with couches were uniform on both sides so that an individual cushions may be turned over in case one side became soiled. Some later designs even provided couches, sofas or chairs with identical cushions for use in both the seat and the back. All of these prior designs had a tendency for the bottom cushions to scoot forward out of the couch. While many of the prior designs used cushions that may be turned over so that either side was exposed, none of the prior art showed the total reversibility, including patterns or a multiple thereof, as is the case with the present invention. Previous frame structures for couches or sofas did not provide a means for retaining the cushions in position as does the present invention, nor does the prior art provide for the interlocking of the seat and the back cushions.

SUMMARY OF THE INVENTION

It is an object of the present invention to provide a very simply constructed couch having interlocking cushions contained therein.

It is another object of the present invention to provide a unique cushion design for use in couches and sofas.

It is yet another object of the present invention to provide a simple frame for retaining the present cushions therein.

It is even another object of the present invention to provide a couch having a multiple of elongated cushions that form the bottom and back thereof with each cushion having an extension on opposing ends thereof. The extension on the front of the lower cushions overlap the front of the couch with the extension on the rear extending under the back cushion. The back cushion also has extensions with the upper extension overlapping an upper cross support for comfort and the lower extension interlocking with the lower couch cushions. Only the upper half of any cushion will be visible at any one time because the lower half of the cushion is contained within the frame of the couch. By using different material on the upper half and the lower half of each cushion a totally different pattern or portion thereof may be exposed by reversing the cushions.

The frame, which may be made from any substance, in the preferred design is of simple wood construction with the rear leg extending from the bottom to the top of the couch. The arm rest extends forward from the rear leg to the front leg which extends downward therefrom. Basically a rectangular frame encloses the lower seat portion of the couch with horizontal slats extending lengthwise of the couch to support the lower cushions. The rectangular frame has an upwardly extending portion therearound in which the cushion will be maintained thereby exposing only the top half of the cushion. The rear leg extends forwardly to enclose the sides of the back cushions with the upper cross support member securely holding the cushions in position. Again slats extending horizontally along the back of the couch support the cushions contained therein.

A saddlebag type of cushion hangs over the arm rest and is secured into position to the upper portion of the frame.

DESCRIPTION OF THE PREFERRED EMBODIMENT

Figure 1:
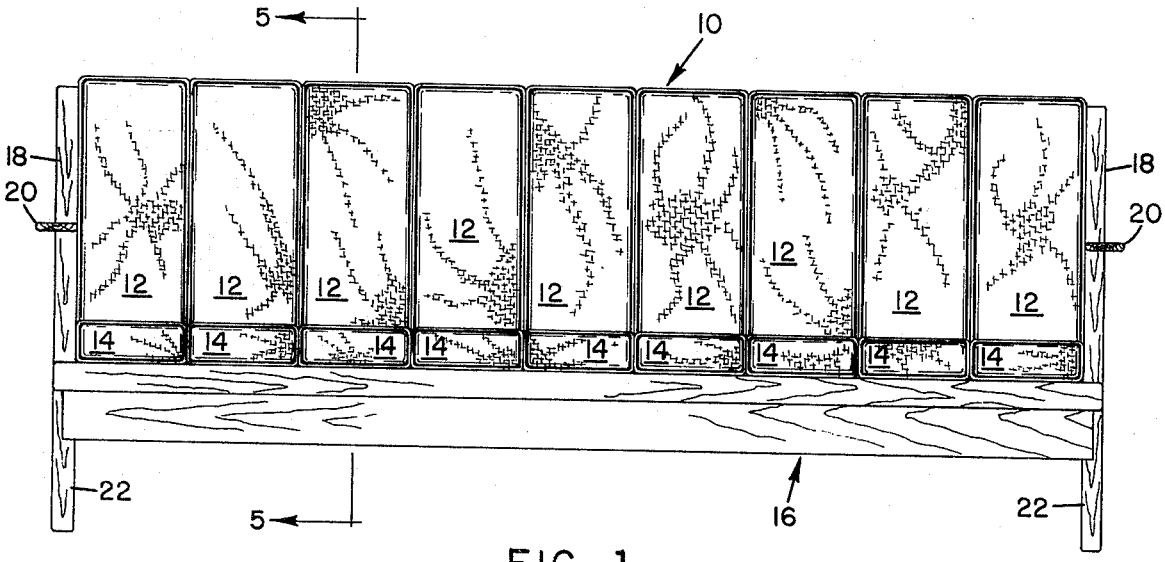
FIG. 1 is a front elevational view of a couch embodying the present invention.

FIG. 1 of the drawings show a couch represented generally by reference numeral 10 embodying the present invention. The couch 10 includes upright cushions 12 extending across the back of the couch 10, and lower cushions 14 extending across the seat of the couch 10. The couch 10 also includes a frame represented generally by the reference numeral 16.

Figure 2:
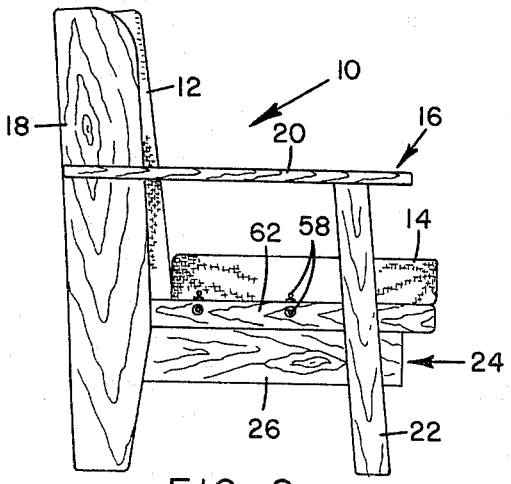
FIG. 2 is a left side view of FIG. 1.

Referring to FIGS. 1 and 2 in combination, the frame 16 includes a rear leg 18 extending from the floor to the top of the couch 10. The rear leg 18, which can be formed from any substance such as a board, will cover at least the rear half of the upright cushion 12. Attached to the rear leg 18 is an arm 20 extending forwardly therefrom. Below the arm 20 is attached a front leg 22 which extends downwardly therefrom to the floor.

Figure 5:
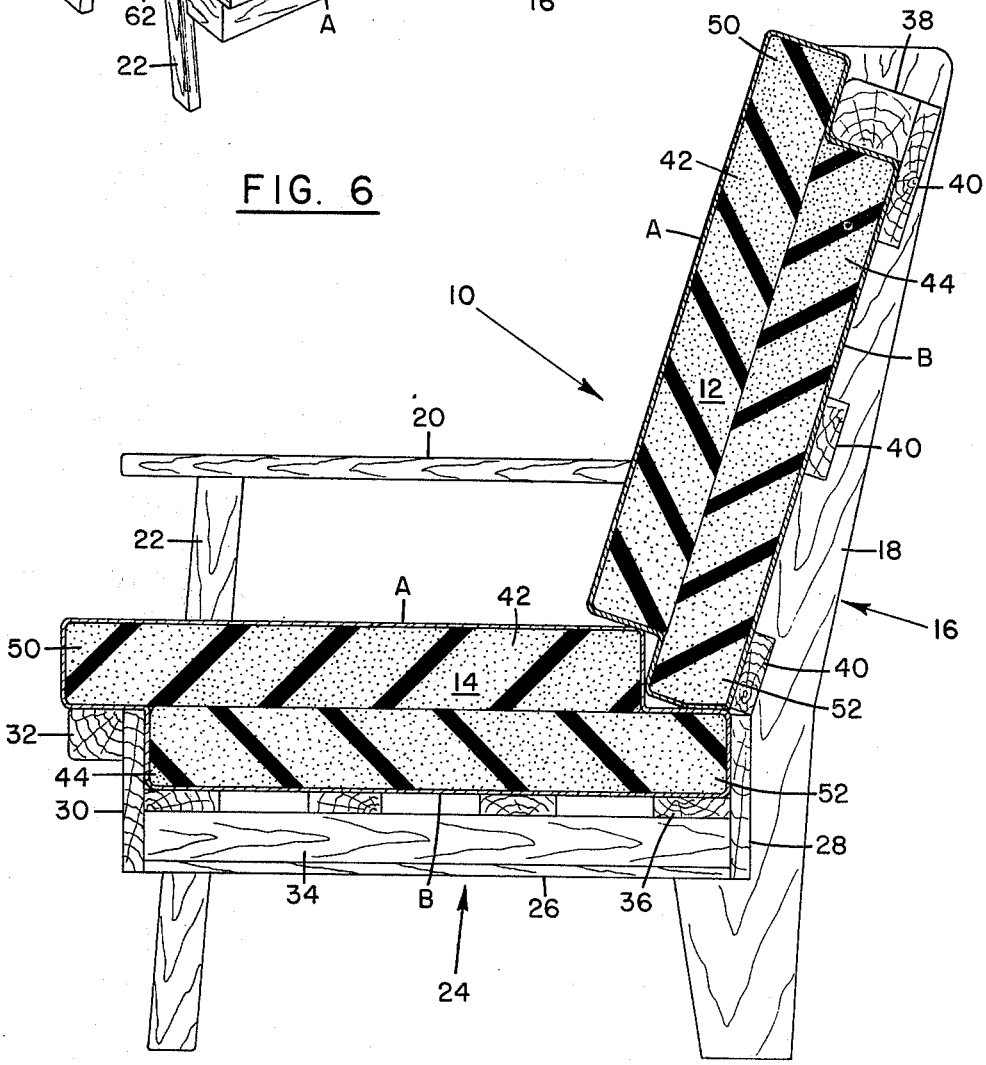
FIG. 5 is a sectional view of FIG. 1 along section lines 5—5.

Referring now to FIG. 5 in combination with previously mentioned FIGS. 1 and 2 a better understanding of the frame 16 and its construction can be obtained. Generally parallel to the floor there is a rectangular seat frame 24 that is attached to legs 18 and 22 approximately one foot from the floor. The rectangular seat frame 24 has a cross member 26 connected to legs 18 and 22. Attached to the rear of the cross members 26 and rear legs 18 is horizontal member 28 forming a portion of the rectangular seat frame 24. Extending across the front of the cross members 26 is another horizontal member 30 forming the front portion of the rectangular frame seat 24. Attached to the upper front of horizontal member 30 is frontal support 32. Inside of rectangular seat frame 24 are located cross supports 34 with the cross supports 34 on each end of couch 10 attaching to the lower portion of cross member 26. Each end of the cross supports 34 is attached to the lower portion of horizontal members 28 and 30. The cross supports 34 are equally spaced throughout the length of the couch to provide support for slats 36 located thereon. (See FIG. 6).

Connected to each of the rear legs 18 is an upper horizontal member 38. Downwardly and inwardly from the horizontal member 38 are a series of equally spaced back slats 40 with the uppermost back slat 40 abutting upper horizontal member 38. While the present invention does not specifically show cross support for the back slats 40, cross supports could be provided for additional strength.

Figure 3:
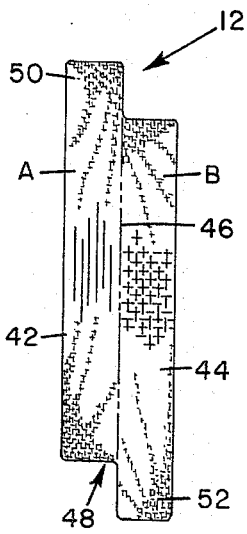
FIG. 3 is a side view of a single cushion used in FIG. 1.
Figure 4:
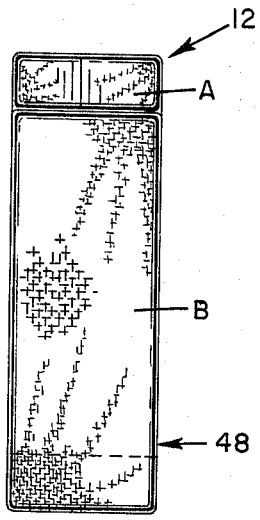
FIG. 4 is a top view of a single cushion used in FIG. 1.

Referring now to FIGS. 3 and 4 there is shown a typical upright cushion 12 and lower cushion 14. Both of the cushions are identical with a lower cushion being replaceable with an upright cushion. For the purposes of this paragraph consider the cushion as shown in FIGS. 3 and 4 to be an upright cushion 12. The upright cushion 12 has two distinct halves with the first half 42 being attached to the second half 44 along seam 46. The two separate halves 42 and 44 are formed from identical rectangular blocks of Styrofoam that are inserted inside of a cushion cover 48 with the remaining seam 46 being sewed together after insertion of the two halves 42 and 44. The first half 42 has an extension 50 that extends beyond second half 44. Likewise, second half 44 has an extension 52 that extends beyond the first half 42. While the cushion cover 48 may be of a single material the preferred embodiment of the present invention is to have the first half of cushion 12 covered with material A and the second half covered with material B. This allows the individual owner of the couch 10 to make any type of color combination desirable by reversing any particular cushion or cushions in the couch 10. All of the cushions 12 and 14 are of identical structure with the approximate width of each cushion being 9 inches; however, this may be varied according to the preference of the individual. Each of the cushions should have a depth through both halves 42 and 44 of approximately 6 inches to insure the necessary comfort upon sitting on couch 10.

Figure 6:
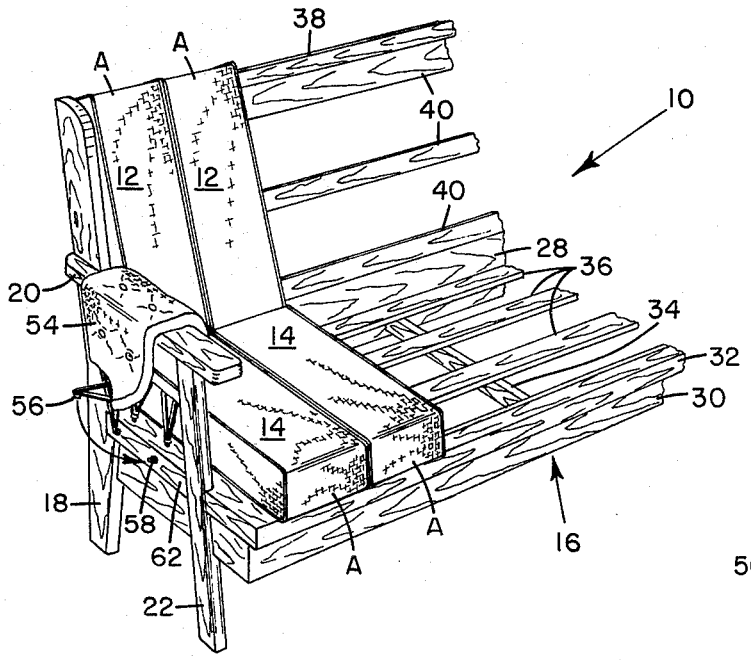
FIG. 6 is a partial perspective view of one end of the couch shown in FIG. 1 with only two lower and upper cushions in position.

Referring now to FIG. 5, the lower cushions 14 are placed inside of rectangular seat frame 24 so that second half 44 is not visible to a person normally viewing the couch 10 (See FIG. 6). The second half 44 covered by material B is entirely contained within horizontal members 28 and 30 and cross members 26. Only the first half 42 that is covered by material A is visible. The extension 50 of first half 42 extends over horizontal member and frontal support 32 to provide comfort to the user of couch 10 while the rectangular seat frame 24 securely holds the lower cushion 14 into position.

The upright cushion 12 also has material A visible to the person normally using the couch 10, while material B is located at the back thereof and is enclosed by leg 18 and upper horizontal member 38. Therefore, a person normally using the couch 10 will only see material A during normal use of the couch 10. The upright cushion 12 has an extension 50 extending forwardly and upwardly over the upper horizontal member 38. The horizontal member 38 rests against the inward end of second half 44. The extension 52 of second half 44 for the upright cushion 12 abutts extension 52 for the lower cushion 14 in a mating notch type of arrangement as can be easily seen in FIG. 5. Because of the downward force exerted by upper horizontal member 38 on second half 44, and the force exerted by lower cushion 14, the upright cushion 12 is snugly held in place.

Now by simply reversing any one or any combination of the cushions 12 and 14, any particular color combination of material A and material B can be formed with the couch 10.

Figure 7:
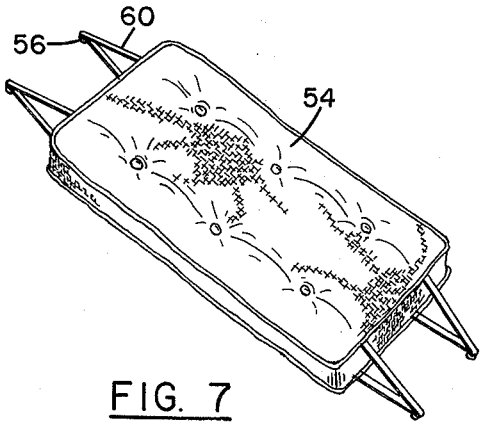
FIG. 7 is a perspective view of the saddlebag cushion used on the arm of the couch as shown in FIG. 6.

Overlapping the arms 20 are saddlebag cushions 54 with each end of the saddlebag cushions 54 being attached to the rectangular frame seat 24. The attachments are provided by cushion snaps 56 mating to frame snaps 58 in the manner as shown in FIG. 6. While the snaps could be directly attached to cushion 54, in the preferred embodiment the cushion snaps 56 are connected to the cushion 54 by snap strings 60. For a perspective view of an individual saddlebag cushion 54, refer to FIG. 7.

The upper frontal support 32 is extended rearwardly on the sides of couch 10 as represented by reference numeral 62 and shown in FIGS. 2 and 6. This extension 62 of frontal support 32 is not essential to the present invention, but aids in overall uniformity of design of the couch 10.

It should be understood that many different sizes of cushions could be used in the present invention without departing from the spirit and intent of this patent. Instead of a couch, a chair for a single individual is encompassed within the scope of this invention as described herein. While only two materials were described with the present invention any number of materials may be used with cushions or cushion covers being changed at will to form any particular color combination as desired.

I claim:

1. A couch of the removable cushion type wherein the couch includes front legs extending from an arm support to the floor, rear legs providing support for a back portion of the couch, lower frame connecting to each of said legs for providing a sitting portion of said couch, said back portion and said sitting portion having horizontal support members for retaining couch cushions in position, the improvement comprising:

said cushions being oblong with extensions on opposing halves of oblong ends;

said horizontal support members of said sitting portion being recessed in said lower frame to receive at least the lower half of said cushions used for said sitting portion;

said cushions filling said lower frame with one extension of said cushions being on the upper side thereof and overhanging a front of said lower frame; said cushions filling said back portion with one extension of said cushions being on the front upper side thereof, said cushions filling said back portion and sitting portion with lower rear extension thereon interlocking to retain said cushions in position.

2. The couch as recited in claim 1 wherein said horizontal support members for said back portion includes a main member providing additional support across the top thereof and downward force against the rear half of said cushions filling said back portion.

3. The couch as recited in claim 2 wherein said rear legs are wide enough to cover the rear half of said cushions filling said back portion.

4. The couch as recited in claim 3 where each cushion has a first material covering an exposed half of said cushion and a second material covering the unexposed half of said cushion, all said cushions being interchangeable and reversible for various color patterns with said first and second materials.

5. The couch as recited in claim 1 further including saddlebag cushions for draping over said arms, said saddlebag cushions including means for removably attaching to said lower frame.

6. A cushion for a couch comprising:

first oblong rectangular block of stuffing material for said cushion;

second oblong rectangular block of stuffing material for said cushion;

cover for said cushion to receive said first and second oblong rectangular blocks with opposing extensions of said cover and enclosed blocks being on opposing ends thereof;

a first material being used to form the cover of said first oblong rectangular block; and a second material being used to form the cover of said second oblong rectangular block;

said first and second material being connected together where said first and second oblong rectangular blocks overlap.

7. The cushion as recited in claim 6 wherein said stuffing material is a type of resilient foam.

8. The cushion as recited in claim 6 wherein said cushions are approximately 9 inches wide and 6 inches thick.

* * * * *